US005585169A

United States Patent [19]

Schnegg et al.

[11] Patent Number: 5,585,169

[45] Date of Patent: Dec. 17, 1996

[54] WARP-KNIT, WEFT-INSERTED FABRIC CONSTRUCTION WITH DYED SUBSTRATE

[75] Inventors: Julius R. Schnegg, Burlington, N.C.; William B. Lowe, Jr., Rutherford, N.J.; Bobby L. McConnell, Greensboro, N.C.

[73] Assignee: Burlington Industries, Inc., Greensboro, N.C.

[21] Appl. No.: 375,735

[22] Filed: Jan. 20, 1995

[51] Int. Cl.[6] ..... B32B 7/00

[52] U.S. Cl. ..... 428/253; 66/190; 66/192; 66/195; 66/202; 428/233; 428/304.4

[58] Field of Search ..... 66/190, 191, 192, 66/194, 195, 202; 428/232, 233, 253, 304.4

[56] References Cited

U.S. PATENT DOCUMENTS

| | | | |
|---|---|---|---|
| 3,279,221 | 10/1966 | Gliksmann . | |
| 4,437,323 | 3/1984 | Hittel et al. . | |
| 4,443,516 | 4/1984 | Rogers . | |
| 4,497,863 | 2/1985 | Cogan, Jr. . | |
| 4,608,290 | 8/1986 | Schnegg . | |
| 4,682,480 | 7/1987 | Schnegg . | |
| 4,724,179 | 2/1988 | Schnegg . | |
| 4,841,749 | 6/1989 | Petracek et al. . | |
| 4,845,960 | 7/1989 | Schnegg . | |
| 4,854,135 | 8/1989 | Petracek et al. . | |
| 5,191,777 | 3/1993 | Schnegg | 66/195 |
| 5,292,576 | 3/1994 | Sanders . | |
| 5,436,064 | 7/1995 | Schnegg et al. | 428/234 |

FOREIGN PATENT DOCUMENTS

| | | |
|---|---|---|
| 2110567 | 6/1983 | United Kingdom . |

*Primary Examiner*—James J. Bell
*Attorney, Agent, or Firm*—Nixon & Vanderhye

[57] ABSTRACT

A non-woven substrate is combined with warps and wefts in a warp-knit, weft-insertion machine to form a decorative fabric and later combined with a foam backing. The substrate is substantially uniformly even over its entire surface and has an opacity sufficient to substantially preclude any visual perception of the substrate from the technical backside of the fabric.

19 Claims, 2 Drawing Sheets

WARP-KNIT, WEFT-INSERTED FABRIC CONSTRUCTION WITH DYED SUBSTRATE

TECHNICAL FIELD

The present invention relates to warp-knit, weft-inserted fabrics and particularly relates to relatively inexpensive warp-knit, weft-inserted fabrics incorporating differently colored and/or textured warp/weft yarns into a solid-colored material, preferably non-woven, having a backing, i.e., a foam back, which is not visually perceptible through the fabric from its technical back side.

BACKGROUND

In recent years, warp-knit, weft-insertion fabrics have increasingly replaced woven-type fabrics, particularly as low-cost alternatives for end-use applications such as drapery fabrics, upholstery and the like. The lower cost of warp-knit, weft-inserted fabrics, as well as their dimensional stability, has contributed to popular use of those fabrics, particularly where the aesthetics of the fabric is not particularly important. Increasingly, however, warp-knit, weft-inserted fabrics are being used in the decorative fabric field where aesthetics are a primary concern.

It is also known to incorporate woven and non-woven substrates into a warp-knitted, weft-inserted construction. See, for example, U.S. Pat. No. 4,841,749. It has been found, however, that the resulting fabrics using non-woven substrates tend to be uneven such that when the fabrics are given a foam backing which is desired for certain drapery or upholstery uses, the foam backing tends to be non-uniformly visually perceptible through the front side of the fabric, i.e. the side typically viewed for its aesthetics characteristics, when using color warp-weft yarns. That is, because of the unevenness of the non-woven substrate, typical of most commercially provided substrates for this purpose, the usual white-colored background of the foam backing becomes prominent and visible in a non-uniform fashion from the technical back side of the fabric. A woven material may be used as a substrate but it is inordinately expensive for these uses. While use of a non-woven substrate is therefore indicated in the decorative fabrics field, non-woven substrate materials are typically uneven and, when used as a colored background for the warp and weft yarns, together with foam backing, the conventional white foam backing tends to "grin," i.e., non-uniformly appear, through the front side of the fabric.

One of the problems with warp-knit, weft-inserted fabrics has been the production of a fabric with an inexpensive multi-colored texture on solid-colored background. Ordinarily, there are two different ways to produce a solid color decorative fabric The warp and weft yarns may be dyed and placed relatively close together in the fabric to produce the solid color. The dense construction of the warp and weft yarns is important when the decorative fabric is subsequently foam-backed, because any gap would show up as a white "grin through," making the fabric look less attractive and valuable. Alternatively, the fabric may be piece-dyed, which is an inexpensive way to achieve a solid-colored fabric. However, all of the yarns are dyed the same color unless differently dyed yarns are used, which adds to the expense. Thus, the problem at hand is to provide an inexpensive solid-colored fabric that incorporates differently-colored and/or textured warp/weft yarns into a solid-colored background which, when foam-backed, does not show the color of the foam backing through the fabric from its technical back side.

DISCLOSURE OF THE INVENTION

The present invention provides a novel and improved warp-knit, weft-inserted fabric which minimizes or eliminates the foregoing and other problems associated with prior warp-knit, weft-inserted fabrics and provides such novel and improved inexpensive warp-knit, weft-inserted fabric particularly useful as a decorative fabric. To accomplish this, a non-woven substrate has been identified which may be dyed inexpensively and has an opacity such that, when combined with a warp-knit, weft-inserted fabric and backed by a white foam, the white color of the foam will not be visually perceptible from the technical back side of the finished fabric. The substrate material is a polyester material known as Brand No. 215 Adhesive-Type Substrate, manufactured by Fiber Dynamics, High Point, N.C. and weighs 0.6 oz./sqy. Brand No. 225, which is a heavier substrate, may also be used and weighs 0.73 oz/sqy. The latter substrate is more opaque than Brand No. 215 and is only slightly more expensive. This particular substrate may be dyed in the manufacturing process, which also reduces the dyeing cost considerably in comparison with piece-dyeing the substrate after manufacture. Thus, the dyed substrate can then be combined in a warp-knit, weft-insertion fabric which can then be subsequently provided with a foam backing. The evenness of the substrate substantially precludes "white grins" showing through the technical back side of the fabric. This enables the warp and weft decorative yarns to be placed over the substrate in a warp-knit, weft-insertion machine without having to provide complete coverage with the decorative yarns, and allowing them to stand out against the background of the differently-colored non-woven substrate. Further, with a basic ground color, differently dyed yarns may be incorporated into the fabric to provide a more pleasing decorative fabric. Consequently, the color of the substrate can be changed by dyeing the substrate differently, while using the same color warp and weft yarns and the same foam backing system. Alternatively, the warp and weft yarns may be provided in different colors, maintaining the same color of the background substrate.

In a preferred embodiment according to the present invention, there is provided a warp-knit, weft-inserted fabric comprising warp yarns extending in a warp direction and weft yarns extending in a weft direction, a non-woven substrate having substantially uniform opacity over its entire surface, the warp yarns being stitched through the substrate to secure the warp and weft yarns to the substrate.

In a further preferred embodiment according to the present invention, there is provided a warp-knit, weft-inserted fabric comprising warp yarns extending in a warp direction and weft yarns extending in a weft direction, a non-woven substrate having thick and thin areas distributed over the entire surface of the substrate, the substrate having a difference in the percent of light transmitted of a range of 10% or less and the warp yarns being stitched through the substrate to secure the warp and weft yarns to the substrate.

Accordingly, it is a primary object of the present invention to provide a warp-knit, weft-inserted fabric construction with a solid-colored dyed substrate which, when foam-backed, does not show the foam backing through the fabric when viewed from its technical back side.

BEST MODE FOR CARRYING OUT THE INVENTION

Figure 1:
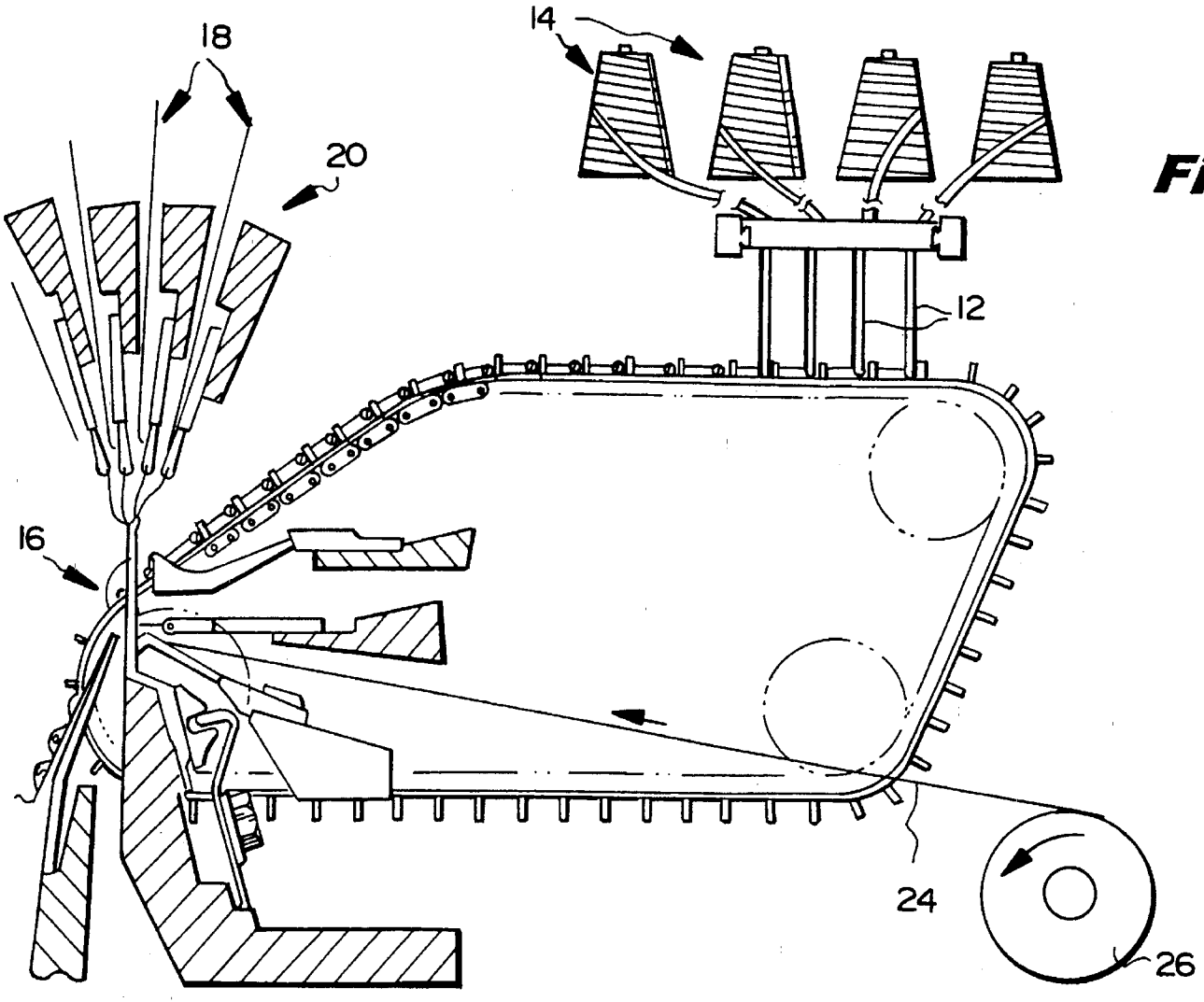
FIG. 1 is a side schematic view, partly in cross-section and partly in elevation, diagrammatically illustrating apparatus utilized in the production of the warp-knit, weft-inserted fabric hereof.

Referring to FIG. 1, there is illustrated a warp-knit, weft-insertion machine of known construction wherein weft yarns 12 are fed from cones 14 to the knitting area 16, while warp knitting yarns 18 are fed via guide bars 20 to the knitting area 16. Additionally, a substrate 24 is fed from a reel 26 into the knitting area 16. The substrate is preferably a non-woven backing, preferably a polyester or polypropylene, and which substrate is highly even. That is, the substrate has a substantially uniform concentration of fibers throughout its entire area in contradistinction to an uneven substrate, which would have a greater concentration of fibers in certain areas of the substrate and a lesser concentration of fibers in other areas. The uneven substrate would therefore have an opacity which is not evenly distributed over the entirety of the substrate. A substrate which has been found to be eminently suitable for this purpose is manufactured and sold by Fiber Dynamics. High Point, N.C., under Brand No. 215, Adhesive-Type Substrate. Brand No. 225 may also be used. It will be appreciated that a woven fabric can be used as the substrate as well. However, woven fabric is considerably more expensive than a non-woven and, from a practical commercial standpoint, cannot be used. The substrate 24 would be typically dyed or colored for aesthetic matching with the color of the warp and weft yarns.

Figure 2:
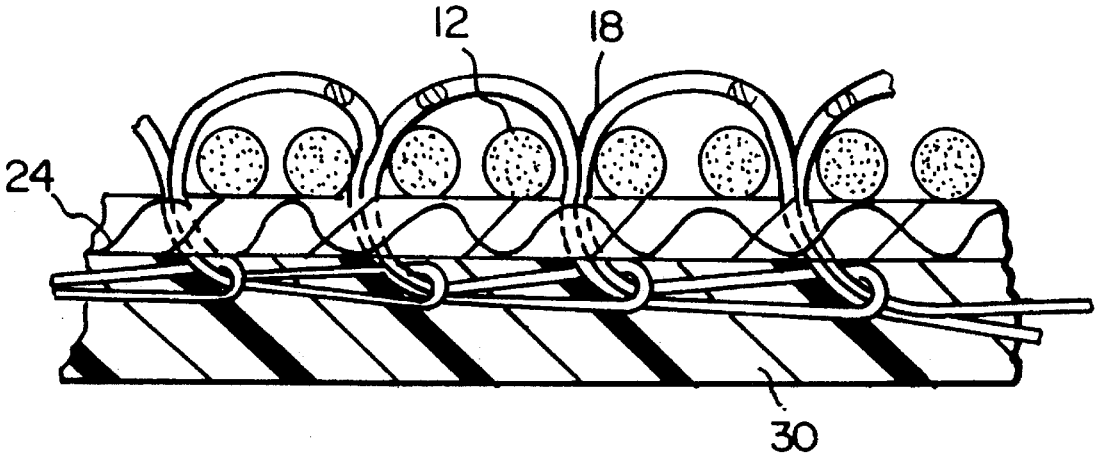
FIG. 2 is a side schematic cross-sectional view of a fabric according to the present invention illustrating a single substrate layer and a foam backing.

In FIG. 2, there is illustrated a fabric, as previously described with respect to FIG. 1, having a backing, preferably a foam backing 30, applied to the fabric after its formation. Thus, for decorative fabrics such as draperies, a foam may be applied to the technical front side of the fabric using conventional techniques. The foam backing may be an acrylic-type foam with or without cotton flocking to give the foam a more textile hand.

It will be appreciated that the substrate is dyed, affording a single color, and that the warp and weft yarns may likewise be of a single color different than or the same as the substrate color, as well as different from one another. Additionally, individual yarns may be of different color than other yarns. However, the problem of the unevenness of the substrate and the resulting appearance of "grin throughs" from the white foam backing material through the substrate and warp and weft yarns remains, except for a substrate having very high degree of evenness in its fiber distribution and, hence, high opacity as provided by the present invention. The above-identified substrate commercially available from Fiber Dynamics has the requisite evenness and high degree of opacity to afford usage in the fabric of the present invention. That is, the opacity of the substrate is sufficiently high so that the foam backing does not show through the substrate and warp and weft yarns. Thus, there is provided a decorative fabric with good texture and a foamed back, the capacity of forming the fabric using relatively inexpensive warp-knit. weft-insertion techniques and the capability of providing a multitude of fabric colors and patterns.

To demonstrate the difference that the evenness or unevenness has on the resulting appearance of the fabric, reference is made to the following table:

| | Photometer Reading (f/c) | % of Light Transmitted |
|---|---|---|
| Style 6811 Thinner Area | 11 | 55.0 |
| | 12 | 60.0 |
| | 10 | 50.0 |
| Average | 11 | 55.0 |
| Thicker Area | 8 | 40.0 |
| | 7 | 35.0 |
| | 6 | 30.0 |
| Average | 7 | 35.0 |
| Style 215 Thinner Area | 8 | 40.0 |
| | 9 | 45.0 |
| | 9 | 45.0 |
| Average | 8.7 | 43.3 |
| Thicker Area | 8 | 40.0 |
| | 8 | 40.0 |
| | 7 | 35.0 |
| Average | 7.7 | 38.3 |

The table shows comparable measurements of light transmission through a FiberTech Group Inc. substrate Style 6811 and a dyed substrate (in white) Style 215. The substrate Style 6811 is characteristically uneven, while the substrate Style 215 is substantially more even. Style 6811 also lacks a uniform distribution of fibers throughout its area. In both cases, therefore, there are thin and thick areas of fibers in the substrates. Further, the substrate Style 6811 is 0.70 oz./sqy in weight and the Style 215 substrate is 0.60 oz./sqy. Style 215 should therefore be less opaque than Style 6811 but by using finer denier yarn, Style 215 is actually more opaque than Style 6811. The substrate Style 215 is the substrate identified above as commercially available from Fiber Dynamics, High Point, N.C., under Brand No. 215 and is comprised of an approximate 50/50 mixture of 0.9 and 1.5 denier fibers, respectively, with extra careful carding to parallel the fibers. Brand No. 225 has the same denier but is in a mixture of about 30% 0.9 denier fibers and about 70% 1.5 denier fibers and is therefore slightly heavier than Brand 215. Style 6811 is formed of 60% 1.5 denier and 40% 1.2 denier staple fibers. The above table discloses the magnitude of the light which penetrates the fabric. The higher the photometer reading, the less opaque and, conversely, the lower the photometer reading, the more opaque.

The test was conducted in accordance with AATCC Test Method 148-1989, the test method being modified to provide an original reading of 20 foot/candles by masking the light transmittance opening to 1 square inch. Each of the thin and thick areas of both samples were tested using the 1 square inch area.

As can be seen from a reading of column 1, the photometer readings for thin areas of Style 6811 averaged 11 foot/candles, while similar readings on thicker areas average 7 foot/candles, i.e., a greater opacity. The percent of light transmitted for the thin area was 55%, while for the thicker area, the transmission was 35%. That is, Style 6811 exhibited a difference in light transmission characteristics of 20 percentage points between thick and thin areas, Referring to the photometer readings for the Style 215 substrate, the thin and thick areas recorded an average of 8.7 and 7.7 foot/candles of light transmission. The average percent of light transmitted through the thin area was 43.3% and through the thick area was 38.3%. This clearly demonstrated the superior opacity characteristics of the Style 215 substrate as compared with the Style 6811 substrate. That is to say, Style 215 has only a difference in light transmission of 5 percentage points, whereas the difference in light transmission for the Style 6811 between the thin and thick areas was 20 percentage points. The difference in light transmissivity or opacity characteristics between the thick and thin areas of Style 215 substrate are insufficient to be discernible when the substrate is used in a warp-knit, weft-inserted fabric with a foam packing, as previously discussed. Thus, grin throughs are avoided. Thus, a substrate having a percent difference in light transmitted through thick and thin areas of a range of 10 percentage points and preferably on average of about 5 percentage points is suitable for use in the fabric of the present invention.

While the invention bas been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A warp-knit, weft-inserted fabric comprising:

warp yarns extending in a warp direction and weft yarns extending in a weft direction;

a non-woven substrate having substantially uniform opacity over its entire surface; and said warp yarns being stitched through said substrate to secure said warp and weft yarns to said substrate.

2. A fabric according to claim 1 including a foam backing on said substrate and on a side thereof remote from the technical back side of the fabric.

3. A fabric according to claim 2 wherein the opacity of said substrate is such as to substantially obscure any visual recognition of said foam backing from the technical back side of the fabric.

4. A fabric according to claim 2 wherein the opacity of said substrate is such as to substantially obscure any visual perception of the color of the foam backing from the technical back side of the fabric.

5. A fabric according to claim 4 wherein the color of the substrate is different than the color of at least one of said warp yarns and said weft yarns.

6. A fabric according to claim 4 wherein the color of the substrate is the same as the color of at least one of said warp yarns and said weft yarns.

7. A fabric according to claim 4 wherein the color of the substrate is different than the color of each of said warp yarns and said weft yarns and the color of said warp yarns is different from the color of said weft yarns.

8. A fabric according to claim 4 wherein said substrate has a weight of about 0.6 oz./sqy or more.

9. A warp-knit, weft-inserted fabric comprising:

warp yarns extending in a warp direction and weft yarns extending in a weft direction;

a non-woven substrate having thick and thin areas distributed over the entire surface of said substrate, said substrate having a difference in the percent of light transmitted of a range of 10% or less; and said warp yarns being stitched through said substrate to secure said warp and weft yarns to said substrate.

10. A fabric according to claim 9 wherein for an original one square inch area in both the thick and thin areas of the substrate and for an original 20 foot/candle light source, the difference between the light transmission through the thick and thin areas of the substrate is about 1 foot/candle.

11. A fabric according to claim 10 wherein said substrate has a weight of about 0.6 oz./sqy or more.

12. A warp-knit, weft-inserted fabric comprising:

warp yarns extending in a warp direction and weft yarns extending in a weft direction;

a non-woven substrate having substantially uniform opacity over its entire surface;

said warp yarns being stitched through said substrate to secure said warp and weft yarns to said substrate;

a foam backing on said substrate and on a side thereof remote from the technical back side of the fabric;

the opacity of said substrate being such as to substantially obscure any visual perception of the color of the foam backing from the technical back side of the fabric; and said substrate being formed of staple fibers comprising a mixture of 0.9 and 1.5 denier fibers.

13. A warp-knit, weft-inserted fabric comprising:

warp yarns extending in a warp direction and weft yarns extending in a weft direction;

a non-woven substrate having thick and thin areas distributed over the entire surface of said substrate, said substrate having a difference in the percent of light transmitted of a range of 10% or less;

said warp yarns being stitched through said substrate to secure said warp and weft yarns to said substrate; and wherein for an original one square inch area in both the thick and thin areas of the substrate and for an original 20 foot/candle light source, the difference between the light transmission through the thick and thin areas of the substrate is about 1 foot/candle;

said substrate being formed of staple fibers comprising a mixture of 0.9 and 1.5 denier fibers.

14. A warp-knit, weft-inserted fabric comprising:

warp yarns extending in a warp direction and weft yarns extending in a weft direction;

a non-woven substrate having thick and thin areas distributed over the entire surface of said substrate, said substrate having a difference in the percent of light transmitted of a range of 10% or less;

said warp yarns being stitched through said substrate to secure said warp and weft yarns to said substrate; and wherein for an original one square inch area in both the thick and thin areas of the substrate and for an original 20 foot/candle light source, the difference between the light transmission through the thick and thin areas of the substrate is about 1 foot/candle;

said substrate having a weight of about 0.6 oz./sqy and being formed of staple fibers comprising a mixture of 0.9 and 1.5 denier fibers.

15. A fabric according to claim 2 wherein said foam backing is white in color, said substrate being of a color other than white.

16. A fabric according to claim 2 wherein the color of said foam backing is different than the color of said substrate, the opacity of said substrate being such as to substantially obscure any visual perception of the color of the foam backing from the technical back side of the fabric.

17. A fabric according to claim 12 wherein the colors of said foam backing and said substrate are different from one another.

18. A fabric according to claim 13 including a foam backing on said substrate and on a side thereof remote from the technical back side of the fabric, the color of said foam backing and said substrate being different from one another.

19. A fabric according to claim 1 including a foam backing on said substrate and on a side thereof remote from the technical back side of the fabric, said non-woven substrate having thick and thin areas distributed over the entire surface of said substrate, said substrate having a difference in the percent of light transmitted therethrough for a given light source of a range of 10% or less, the color of said foam backing and said substrate being different from one another, the opacity of said substrate being such as to substantially obscure any visual recognition of said foam backing from the technical back side of the fabric.

* * * * *